United States Patent [19]

Piazza

[11] Patent Number: 4,610,639

[45] Date of Patent: Sep. 9, 1986

[54] SIMULATED FLYING CREATURE WITH FLAPPABLE WINGS

[75] Inventor: Pietro Piazza, Prospect, Conn.

[73] Assignee: Coleco Industries, Inc., West Hartford, Conn.

[21] Appl. No.: 703,305

[22] Filed: Feb. 20, 1985

[51] Int. Cl.[4] ..... A63H 3/14

[52] U.S. Cl. ..... 446/327; 446/376

[58] Field of Search ..... 446/330, 272, 329, 268, 446/365, 272, 359, 297, 298, 327, 376, 379

[56] References Cited

U.S. PATENT DOCUMENTS

| | | | |
|---|---|---|---|
| 368,831 | 8/1887 | Henn | 446/272 |
| 1,567,661 | 12/1925 | Levaggi et al. | 446/268 |
| 2,009,683 | 7/1935 | Wood | 446/330 |
| 2,036,328 | 4/1936 | Furey . | |
| 2,614,365 | 10/1952 | Musselwhite et al. | 446/330 |
| 2,637,939 | 5/1953 | Polk . | |
| 3,053,008 | 9/1962 | Pelunis | 446/330 |
| 3,153,871 | 10/1964 | Semba . | |
| 3,577,670 | 5/1971 | Gutierrez . | |
| 4,244,138 | 1/1981 | Holahan et al. . | |
| 4,307,533 | 12/1981 | Sims et al. . | |

FOREIGN PATENT DOCUMENTS

| | | | |
|---|---|---|---|
| 476252 | 12/1937 | United Kingdom | 446/365 |
| 1374330 | 11/1974 | United Kingdom | 446/329 |

*Primary Examiner*—Mickey Yu

[57] ABSTRACT

A toy creature includes a one-piece member providing wings that can be reciprocated, by direct manual force, to simulate a flapping action. The creature may include legs that permit it to grasp an object for unassisted support thereon.

18 Claims, 6 Drawing Figures

SIMULATED FLYING CREATURE WITH FLAPPABLE WINGS

BACKGROUND OF THE INVENTION

Toys capable of animation have long found widespread appeal among children, and are disclosed in numerous forms in the prior art. One form of such action toys simulates a creature having wings that are movable in a flapping action, as disclosed in the following U.S. Pat. Nos.: 2,036,328 to Furey; 2,637,939 to Polk; 3,153,871 to Semba; 3,577,670 to Gutierrez; 4,244,138 to Holahan et al; and 4,307,533 to Sims et al.

More particularly, the Furey patent describes a toy insect having movable wings that are operatively connected to a pair of ground-engaging wheels.

A flapping wing toy, constructed to simulate a bird or butterfly, is shown in the Polk patent; it employs a pair of hinged arms, oscillated by finger pressure, to which the wing sections are attached.

Semba shows the use of an electric motor to animate various parts of a bird toy, including the wings; projections on a rotated disc successively engage a rod to which the wings are attached, oscillating the rod and thereby causing a fluttering effect of the wings.

Gutierrez discloses a wing flapping toy in which the wings are loosely mounted upon a handle, and are held in place by a rubber band. The handle has a spring-like portion which terminates in a pair of parallel ears, disposed to force the wings to elevated positions when the handle is squeezed.

The Holahan et al patent describes an animated bird toy in which a trigger-like lever, pivotably mounted upon the body, is operated to simulate flapping of outwardly extending portions of the wings.

In the toy insect of the Sims et al patent, four wings are rotatably mounted upon pins attached to hinged mounting plates. The plates are acted upon by a lever to elevate the wings against the force of gravity.

It is of course desirable to achieve optimal visual appeal, functional effectiveness, and durability in any such toy, while minimizing the complexity of the animating function and the cost of manufacture. Also, to enhance the lifelike impression made by a toy creature, it is sometimes desirable to provide it with self-support means, by which it can give the appearance of independently clinging to or climbing upon an object. Despite the level of prior art activity indicated above, a demand remains for toys of unique construction, in which the foregoing criteria are realized.

Accordingly, it is a broad object of the present invention to provide a novel toy creature having manually actuated flappable wings, which is of relatively inexpensive, uncomplicated and durable construction.

A more specific object of the invention is to provide a toy winged creature in which the wings are provided by a single, integrally formed piece.

It is also an object of the invention to provide such a toy creature which has the capability of supporting itself upon an object without assistance, by means that is relatively simple and yet highly effective.

SUMMARY OF THE INVENTION

It has now been found that certain of the foregoing and related objects of the invention are readily attained by the provision of a toy creature having manually actuated flappable wings, comprised of a one-piece, generally planar wing member, assembled with a creature body. The wing member consists of a central portion and outer portions extending in generally opposite directions therefrom, the outer portions being resiliently deflectable relative to one another by manual force applied to the central portion. An upwardly opening cavity is formed into the body of the creature, and the wing member is mounted thereupon with the outer wing portions extending laterally from the body and with the central portion positioned over the cavity. Laterally spaced elements are also provided on the body for retaining the wing member, which elements extend transversely thereover and in general registration with the elements of the body that define the lateral upper edges of the cavity. Consequently, an operator can insert his finger between the retaining elements to depress the central portion of the wing member into the body cavity, thereby causing the edge elements of the body to deflect the outer wing portions upwardly about the retaining elements, alternate application and release of such force being effective to simulate flapping motion of the wing members.

Normally, the central portion of the wing member will be dimensioned and configured to facilitate its insertion into the body cavity. Also, the cavity-edge defining elements will generally be substantially rectilinear, with a cross section configured to provide smooth transition surfaces for movement of the central portion. The cavity itself (taken in a plane parallel to that of the wing member) will usually be symmetrical about a centerline therethrough, with upper edge elements that converge at a slight angle (e.g., 2°) toward the centerline, and the lower surface of the cavity will advantageously be semicircular.

In certain embodiments, elements of the wing member lying in laterally contiguous relationship to the central portion will be of reduced transverse dimension. The outwardly lying wing portions may have rigidifying projections extending lengthwise therealong, with the contiguous elements of the wing member being substantially free thereof to maintain inherent flexibility for deflection of the outer portions. The central portion will, however, advantageously have a pair of laterally spaced, transversely extending rib elements projecting therefrom and disposed inwardly of the retaining elements of the body, to interfere therewith and thereby prevent substantial lateral displacement of the wing member as a whole. Most desirably, the wing member will be integrally formed from a single sheet of a semi-rigid synthetic resinous material, which may be a laminate including a component that provides iridescence to the member.

The wing-retaining elements will normally be substantially rectilinear, and preferably their lower edges will be bevelled to accommodate the upward deflection of the outer wing portions. Most advantageously, the retaining elements will be provided by a separate retaining piece assembled with the body; in one desirable form, the retaining piece will comprise an upper frame-like portion having an opening shaped to correspond to that of the body cavity.

The toy creature will usually include leg structure on the body, normally providing a multiplicity of limbs simulating legs extending generally downwardly therefrom. Each of such limbs may be outwardly bowed, and may also have an inwardly directed foot element thereon, both features serving to adapt the leg structure for gripping of an object inserted within the space between the limbs; the leg structure may be provided as a separate piece, and may be fabricated from a resiliently deflectable material to facilitate such insertion. The retaining elements are also desirably provided by a separate retaining piece assembled with the body, the leg and retaining pieces being fastened to one another with body and wing member therebetween and secured in assembly thereby.

It may be especially desirable to employ two generally symmetrical pieces as the leg-simulating structure, each piece having a plurality of limbs thereon and connecting portions extending laterally inwardly of the body for assembly with one another. In such instances, the retaining piece will desirably include at least one depending post portion which passes through the body and the leg pieces to secure the assembly. Finally, a clamping piece may be employed beneath the leg pieces for fastening to the post portion of the retaining piece, to cooperate in securing all of the pieces together.

DETAILED DESCRIPTION OF THE ILLUSTRATED EMBODIMENT

Figure 5:
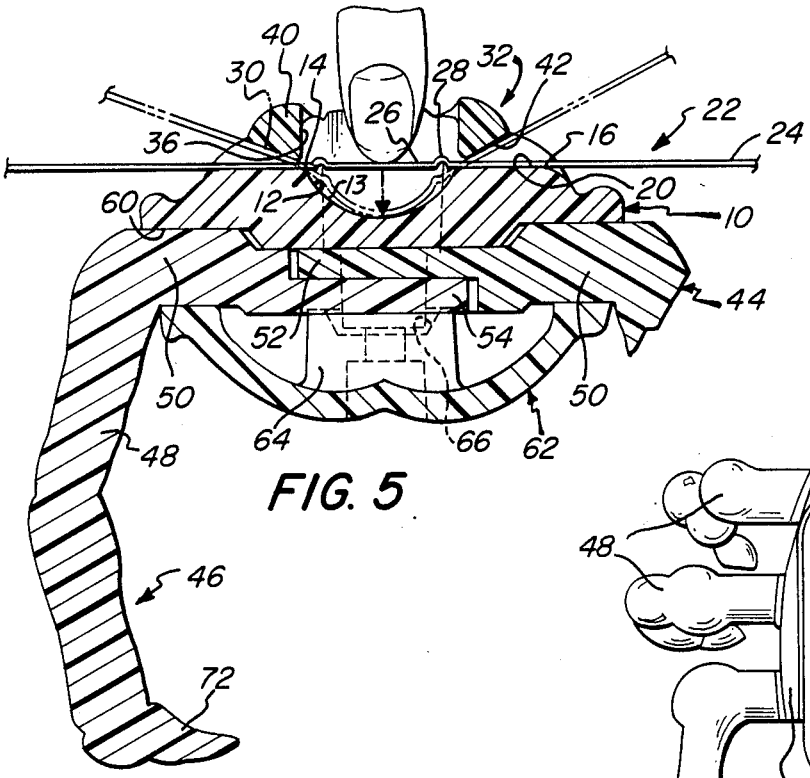
FIG. 5 is a fragmentary sectional view of the assembly taken along line 5—5 of FIG. 2, drawn to a slightly enlarged scale and showing the at-rest and deflected positions of the outer wing portions in full and phantom line, respectively.
Figure 6:
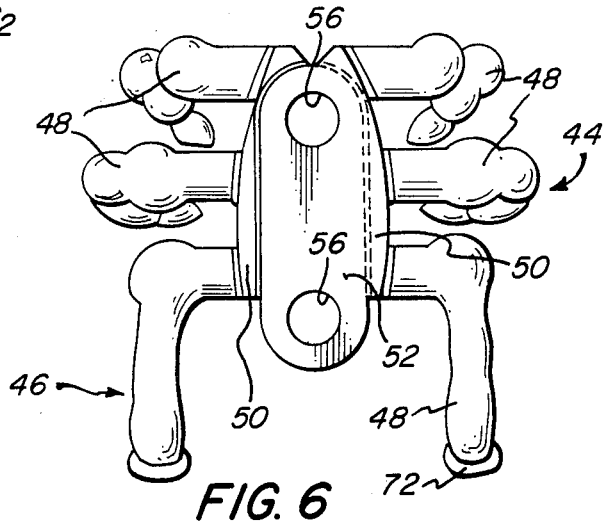
FIG. 6 is a plan view of the leg piece sub-assembly employed in the toy creature, drawn substantially to the scale of FIG. 2.

Turning now in detail to the appended drawings, therein illustrated is a toy winged creature embodying the present invention and including an elongated, insect-like body, generally designated by the numeral 10. Its appearance is designed to convey a science-fiction thematic effect, but it will be understood that this is a matter of aesthetic choice, and is not to be taken as a limitation upon the inventive concepts. A downwardly extending shallow cavity 12, of generally rectangular cross section, is defined in the body 10 by a semicircular inside surface 13 (taken in a laterally extending, vertical plane); the cavity 12 is symmetrical about a longitudinal center line, and is partially defined by lateral upper edge elements 14 which converge toward one another in the forward direction. As is best seen in FIG. 5, the edge elements 14 are curved (in cross section) to provide smooth transition surfaces between the upper body surface 16 and the inside cavity surface 13. A pair of relatively large passages 18 extend through the body 10, on an anterior-posterior axis, at locations adjacent the forward and rearward ends of the cavity 12, and the openings to the cavity 12 and the passages 18 lie within a recessed area 20 that is formed into the upper surface of the body.

A wing member, generally designated by the numeral 22, is assembled with the body 10 and is seated within the recess 20, which is configured to permit it to extend thereacross in a normal (at rest) position in contact with the surface 16. As can be seen, the wing member 22 is integrally formed as a single piece, and consists of a central portion 26 and outer portions 24, which extend laterally therefrom and outwardly of the body. The central portion 26 has a configuration corresponding to the symmetrical, slightly trapezoidal configuration of the body cavity 12 (as viewed in a parallel plane), but is of somewhat smaller dimensions; it has along its lateral edges a pair of spaced, upstanding rectilinear rib elements 28, extending generally transversely thereacross with a slight degree of convergence. The outer wing portions 24 are joined to the central portion 26 through narrow connecting elements 30, which are of reduced transverse dimension relative to the central and outer wing portions 26, 24. It will be noted that the outer wing portions are configured with a pattern of raised, longitudinally extending vein-like projections 27, which serve to enhance the visual effect of the wing as well as to increase its rigidity; the central portion 28 and the connecting elements 30 are devoid of such configuration, so as to ensure adequate flexibility for wing actuation.

The wing member 22 is held in place upon the body 10 by the retaining piece, generally designated by the numeral 32. It includes a frame-like clasp portion 34, through which is formed an opening 36 configured to conform substantially to the size and shape of the body cavity 12. A pair of longitudinally spaced compound post portions 38 project downwardly from the clasp portion 34, and are inserted through the passages 18 to assemble the retainer with the body 10. As best seen in FIG. 5, the rectilinear retaining elements 40 of the clasp portion 34 register with the edge elements 14 defining the body cavity 12, and the raised rib elements 28 on the wing member 22 extend therealong and inwardly thereof.

Based upon the description thus far provided, the manner by which the wing member 22 can be actuated to simulate a flapping motion will readily be appreciated. The operator simply inserts one of his fingers through the opening 36 of the retainer 32, to push directly upon the central portion 26 of the wing member 22 and thereby depress it into the cavity 12 of the body 10. This will cause the outer wing portions 24 to be deflected upwardly by the reactive forces exerted as the connecting elements 30 slide over the curved surfaces of the upper edge elements 14 along the sides of the cavity, ultimately causing the wing portions to abut against the surfaces 42 of the retainer elements 40 in their fully elevated positions; the surfaces 42 are bevelled for that purpose, typically at an angle of about 25° to horizontal. Release of force will enable the wing member to resume its normal, generally planar condition, by virture of its inherent resiliency, with the central portion 26 elevated from the cavity 12 and the wing portions 22 resting upon the body surface 16. Alternate pressure and release will of course simulate a fluttering or flapping wing motion.

It will be understood that the opposite ends of the wing member 22 must be free to shift slightly under the retaining elements 40 (i.e., inwardly as the central portion 26 is depressed, and outwardly upon release) for such flapping action to occur, and this must take place without excessive lateral displacement of the wing member as a whole. For these reasons, the retaining elements 40 are spaced slightly above the surface 16, and the upstanding rib elements 28 are made sufficiently high to intercept the elements 40 and thereby trap the central portion of the wing member within the opening 26 of the retainer frame 34.

The legs of the creature are provided by two separate pieces, generally designated by the numerals 44 and 46, each of which includes three limb portions 48 and a laterally extending connecting portion 50, the latter having marginal elements 52, 54 made to complementarily reduced thicknesses to interfit with one another in lap joint fashion. The outermost, reduced diameter sections 58 of the two posts 38 of the retainer 32 pass through the apertures 56 formed in the elements 52, 54, and the underside of the body 10 is recessed at 60 to accommodate the overlapped portions of the two leg pieces.

Figure 1:
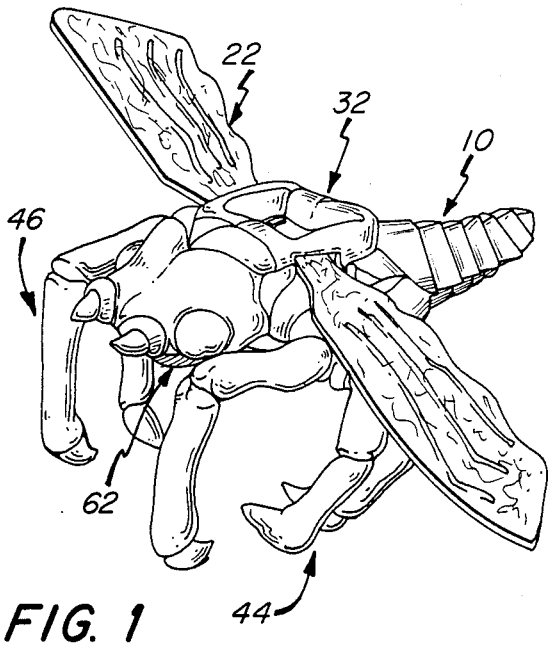
FIG. 1 is a perspective view of a toy winged creature embodying the present invention.
Figure 3:
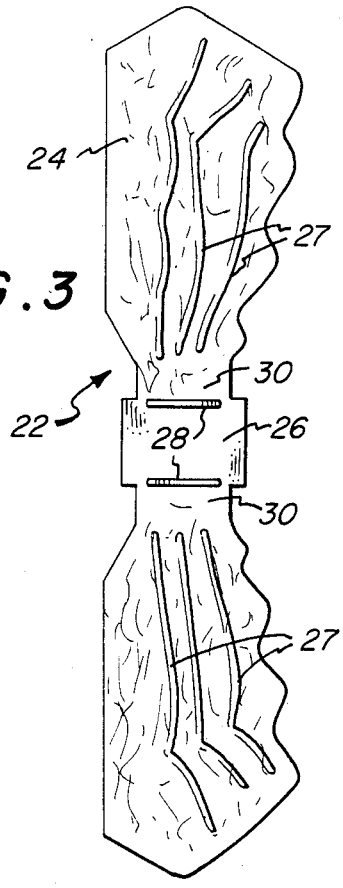
FIG. 3 is a plan view of the wing member employed in the assembly, drawn to a slightly reduced scale.
Figure 2:
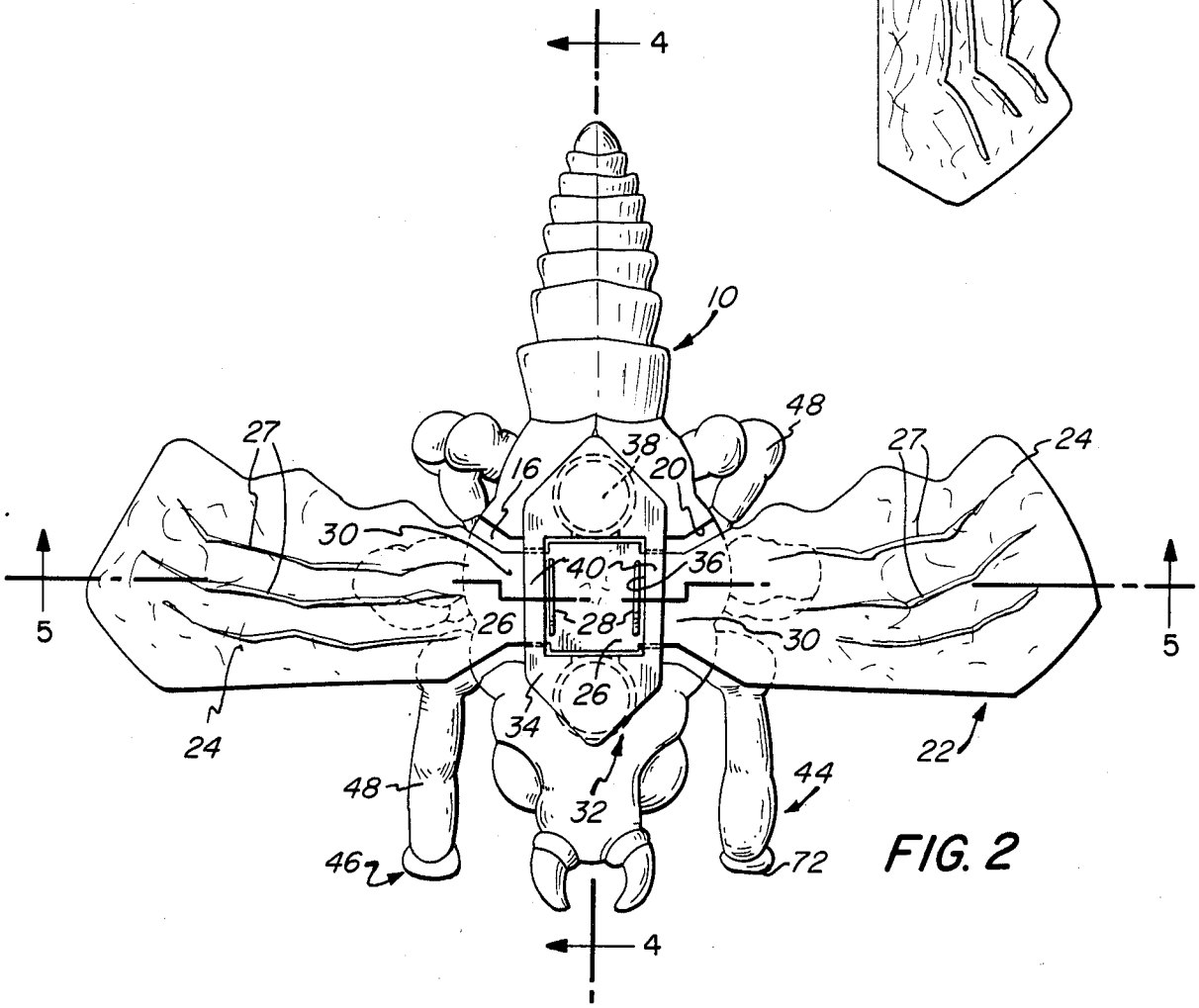
FIG. 2 is a plan view of the creature of FIG. 1, drawn to an enlarged scale.
Figure 4:
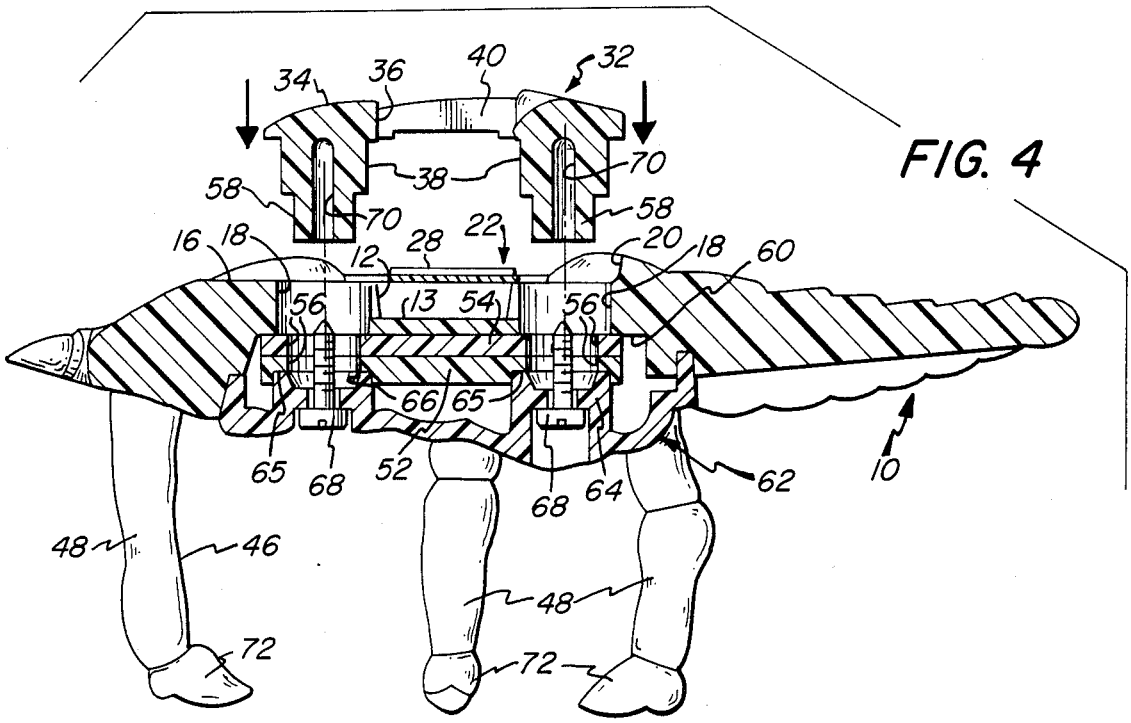
FIG. 4 is an exploded sectional view of the assembly, taken along line 4—4 of FIG. 2.

To complete the assembly, a clamping piece, generally designated by the numeral 62, is secured below the body 10 against the underside of the marginal portion 54 of leg piece 46. It has a pair of internal, longitudinally spaced upstanding cylindrical bosses 64, the ends of which seat in annular grooves 65 formed into the lower surface of the portion 54, and which themselves define circular recesses 66 into which the ends of the retaining member posts 38 are inserted. The assembly is secured by screws 68, which pass upwardly through the web portions within the bosses 64 and into the axial bores 70 of the post portions 38. As can be seen in FIGS. 4 and 5, the body 10 and leg pieces 44, 46, are secured in assembly between the retaining piece 32 and the clamping piece 62, as described.

It will be noted that each of the limbs 48 of the leg pieces 44, 46 has an outwardly bowed configuration and an inwardly directed foot element 72 at its free end. These two features cooperate to adapt the limbs to grasp an object inserted between them; furthermore, the effectiveness of this construction will generally be optimized by fabricating the leg members from a rubbery material (e.g., polyvinyl chloride) to permit elastic return from outwardly deflected positions. As a result, the legs can effectively embrace an object, giving the impression that the creature is independently clinging to it.

Various materials of construction can of course be employed for the several parts of the toy, as will be evident to those skilled in the art. Like the leg pieces, it will usually be desirable to mold them of a synthetic resinous material, additional polymers suitable for use including the polyolefins, the acrylonitrile/butadiene/styrene copolymers, etc. The wings will also normally be fabricated from a synthetic resin, which may be in the form of a laminated sheet (typically about ten mils in thickness) of acetate or vinyl plastic, preferably constructed or treated to provide an iridescent or similar optical effect. A material particularly preferred for use in fabricating the wing of the creature is the proprietary PVC laminate commercially available from the Coburn Corporation, of Lakewood, N.J., under the trade designation DIFRACTO-LIGHT.

Thus, it can be seen that the present invention provides a novel toy creature having manually actuated flappable wings, which is of relatively inexpensive, uncomplicated and durable construction. The wings may be provided by a single, integrally formed piece, and the toy creature may be constructed to afford the capability of unaided support upon an object by means that is relatively simple and yet highly effective.

Having thus decribed the invention, what is claimed is:

1. In a toy winged creature having manually actuated flappable wings, the combination comprising: a one-piece, semirigid, generally planar wing member having a central portion, outer wing portions extending in generally opposite directions therefrom, and a pair of laterally spaced, transversely extending rib elements therebetween projecting from the general plane of said wing member, said outer portions being resiliently deflectable relative to one another by manual force applied to said central portion; and a creature body having an upwardly opening cavity formed therein with lateral upper edges defined by elements of said body, said wing member being loosely mounted upon said body with said outer portions extending laterally therefrom and with said central portion positioned over said cavity, said body also having laterally spaced elements thereon disposed outwardly of said rib elements for retaining said wing member and extending transversely thereover in general registration with said lateral edge-defining elements of said body, whereby an operator can insert his finger between said retaining elements to depress said central portion of said wing member into said cavity, thereby causing said edge-defining elements of said body to deflect said outer wing portions upwardly about said retaining elements, with alternate application and release of such force being effective to simulate flapping motion of said wing member, said rib elements being disposed for interception against said retaining elements to prevent substantial lateral displacement of said wing member as a whole, with respect to said body.

2. The combination of claim 1 wherein said central portion of said wing member is dimensioned and configured for insertion into said body cavity under manual force.

3. The combination of claim 2 wherein said cavity edge-defining elements are substantially rectilinear.

4. The combination of claim 3 wherein said cavity edge-defining elements are configured to provide smooth transition surfaces for facilitating insertion of said central portion of said wing member into said cavity.

5. The combination of claim 1 wherein, in a plane parallel to the plane of said wing member, said cavity is symmetrical with respect to a longitudinal centerline therethrough, and wherein said edge-defining elements converge, at a slight angle, toward said centerline.

6. The combination of claim 5 wherein said cavity has a lower surface of generally semicircular configuration taken along an axis extending laterally of said body.

7. The combination of claim 1 wherein said retaining elements are substantially rectilinear and extend transversely across said wing member.

8. The combination of claim 7 wherein said retaining elements have lower edges which are bevelled to accommodate the upward deflection of said outer wing portions.

9. In a toy winged creature having manually actuated flappable wings, the combination comprising: a one-piece, semirigid, generally planar wing member having a central portion and outer wing portions extending in generally opposite directions therefrom, said outer portions being resiliently deflectable relative to one another by manual force applied to said central portion, said wing member also having elements lying in laterally contiguous relationship to said central portion which are of lesser transverse dimension than said central portion, and said outer portions of said wing member having rigidifying projections extending longitudinally therealong, said contiguous wing elements being substantially free from such rigidifying projections elements to maintain inherent flexibility for deflection of said outer wing portions; and a creature body having an upwardly opening cavity formed therein, with lateral upper edges defined by elements of said body, said wing member being mounted upon said body with said outer portions extending laterally therefrom and with said central portion positioned over said cavity, said body also having laterally spaced elements thereon for retaining said wing member and extending transversely thereover in general registration with said lateral edge-defining elements of said body, whereby an operator can insert his finger between said retaining elements to depress said central portion of said wing member into said cavity, thereby causing said edge-defining elements of said body to deflect said outer wing portions upwardly about said retaining elements, with alternate application and release of such force being effective to simulate flapping motion of said wing member.

10. In a toy winged creature having manually actuated flappable wings, the combination comprising: a one-piece, semirigid, generally planar wing member having a central portion and outer wing portions extending in generally opposite directions therefrom, said outer portions being resiliently deflectable relative to one another by manual force applied to said central portion, said wing member being integrally formed from a single sheet of synthetic resinous material and comprising a laminate of at least two components, at least one of said components providing iridescence to said wing member; and a creature body having an upwardly opening cavity formed therein with lateral upper edges defined by elements of said body, said wing member being mounted upon said body with said outer portions extending laterally therefrom and with said central portion positioned over said cavity, said body also having laterally spaced elements thereon for retaining said wing member and extending transversely thereover in general registration with said lateral edge-defining elements of said body, whereby an operator can insert his finger between said retaining elements to depress said central portion of said wing member into said cavity, thereby causing said edge-defining elements of said body to deflect said outer wing portions upwardly about said retaining elements, with alternate application and release of such force being effective to simulate flapping motion of said wing member.

11. In a toy winged creature having manually actuated flappable wings, the combination comprising: a one-piece, semirigid, generally planar wing member having a central portion and outer wing portions extending in generally opposite directions therefrom, said outer portions being resiliently deflectable relative to one another by manual force applied to said central portion; and a creature body having an upwardly opening cavity formed therein with lateral upper edges defined by elements of said body, said wing member being mounted upon said body with said outer portions extending laterally therefrom and with said central portion positioned over said cavity, said body also having laterally spaced elements thereon for retaining said wing member and extending transversely thereover in general registration with said lateral edge-defining elements of said body, said retaining elements being provided by a separate retaining piece comprising an upper frame-like portion with an opening shaped to correspond to that of said body cavity, said upper portion having side elements thereon providing said retaining elements for said wing member, whereby an operator can insert his finger through said opening of said retaining piece to depress said central portion of said wing member into said cavity, thereby causing said edge elements of said body to deflect said outer wing portions upwardly about said retaining elements, with alternate application and release of such force being effective to simulate flapping motion of said wing member.

12. In a toy winged creature having manually actuated flappable wings, the combination comprising: a one-piece, semirigid, generally planar wing member having a central portion and outer wing portions extending in generally opposite directions therefrom, said outer portions being resiliently deflectable relative to one another by manual force applied to said central portion, a creature body having an upwardly opening cavity formed therein, with lateral upper edges defined by elements of said body, said wing member being mounted upon said body with said outer portions extending laterally therefrom and with said central portion positioned over said cavity, said body also having laterally spaced elements thereon for retaining said wing member and extending transversely thereover in general registration with said lateral edge-defining elements of said body, whereby an operator can insert his finger between said retaining elements to depress said central portion of said wing member into said cavity, thereby causing said edge-defining elements of said body to deflect said outer wing portions upwardly about said retaining elements, with alternate application and release of such force being effective to simulate flapping motion of said wing member; and leg structure provided by at least one separate leg piece assembled with said body and including a multiplicity of limb-simulating legs extending generally downwardly therefrom, each of said legs being outwardly bowed to adapt said leg structure for gripping an object inserted within the space between said legs.

13. The combination of claim 12 wherein each of said legs has an inwardly directed foot element at the free end thereof to enhance its gripping effect.

14. The combination of claim 12 wherein said leg structure is fabricated from a resiliently deflectable material to facilitate insertion of an object for gripping by said legs.

15. The combination of claim 14 wherein said retaining elements are also provided by a separate retaining piece assembled with said body, and wherein said leg and retaining pieces are fastened to one another with said body and wing member therebetween and secured in assembly thereby.

16. The combination of claim 15 wherein said leg structure is provided by two generally symmetrical leg pieces, each of said leg pieces having a plurality of limb-simulating legs thereon and having connecting portions extending laterally inwardly of said body for assembly with one another.

17. The combination of claim 16 wherein said retaining piece has at least one depending post portion thereon, said post portion extending through said body and said connecting portions of said leg pieces for securing said body and leg pieces in assembly.

18. The combination of claim 17 additionally including a clamping piece underlying said leg pieces and bearing thereupon, said clamping piece being fastened to said post portion of said retaining piece to secure all of said pieces in assembly with said body.

* * * * *